US008061071B2

(12) United States Patent
Fitzpatrick et al.

(10) Patent No.: US 8,061,071 B2
(45) Date of Patent: Nov. 22, 2011

(54) AMMUNITION MAGAZINE WITH FOUR AMMUNITION STACKS

(75) Inventors: Richard M. Fitzpatrick, Longmont, CO (US); Michael T. Mayberry, Denver, CO (US); Michael Morgan, Windsor, CO (US); Eric C. Burt, Bromfield, CO (US); Eric S. Nakayama, Broomfield, CO (US)

(73) Assignee: Magpul Industries Corp., Boulder, CO (US)

( * ) Notice: Subject to any disclaimer, the term of this patent is extended or adjusted under 35 U.S.C. 154(b) by 59 days.

(21) Appl. No.: 12/505,419

(22) Filed: Jul. 17, 2009

(65) Prior Publication Data

US 2010/0126053 A1 May 27, 2010

Related U.S. Application Data

(60) Provisional application No. 61/082,819, filed on Jul. 22, 2008.

(51) Int. Cl.
*F41A 9/69* (2006.01)

(52) U.S. Cl. ..... 42/50

(58) Field of Classification Search ..... 42/18, 22, 42/24, 49.01, 50; 89/195, 197
See application file for complete search history.

(56) References Cited

U.S. PATENT DOCUMENTS

| | | | | | |
|---|---|---|---|---|---|
| 1,433,945 | A | * | 10/1922 | Eickhoff | 89/154 |
| 1,859,558 | A | * | 5/1932 | Garand | 42/18 |
| 2,383,998 | A | | 9/1945 | Vesely | |
| 2,391,756 | A | | 12/1945 | Vesely | |
| 3,196,568 | A | | 7/1965 | Reed | |
| 3,345,771 | A | | 10/1967 | Silsby | |
| 3,604,142 | A | | 9/1971 | Silsby | |
| 3,977,114 | A | * | 8/1976 | Poor | 42/50 |
| 4,589,218 | A | | 5/1986 | Teppa | |
| 5,592,769 | A | * | 1/1997 | Villani | 42/1.02 |
| 2005/0188579 | A1 | * | 9/2005 | Gates | 42/50 |

* cited by examiner

*Primary Examiner* — Bret Hayes
(74) *Attorney, Agent, or Firm* — Geoffrey E. Dobbin

(57) ABSTRACT

The present invention is a high capacity, non-drum magazine. The high capacity magazine comprises a broad general storage area capable of holding four staggered stacks of ammunition, a unified follower on a spring system biasing the follower and associated ammunition, a central partition a barrier separating two dual staggered round stacks and around which the follower will pass, and a transition area between the feed end of the magazine and the storage area. The spring may be a composite spring system, made of two springs joined in series, or a single, variable constant, spring.

13 Claims, 8 Drawing Sheets

AMMUNITION MAGAZINE WITH FOUR AMMUNITION STACKS

CROSS-REFERENCES TO RELATED APPLICATIONS

This application claims priority as a perfection of prior filed U.S. Provisional Application No. 61/082,819, filed Jul. 22, 2008 and incorporates the same by reference in its entirety herein.

FIELD OF THE INVENTION

The present invention relates to the field of firearms and more particularly relates to a large capacity ammunition magazine utilizing four varied stacks of ammunition.

BACKGROUND OF THE INVENTION

The present invention is a high capacity magazine utilizing four staggered stacks of ammunition with a single follower and it represents a departure from the prior art in that the high capacity magazine of the present invention allows for four staggered stacks of ammunition to be simultaneously fed through the magazine as each round is sequentially loaded into the firearm. Most high capacity magazines in the prior art are "drum" magazines, where the ammunition is stored in a round chamber. Others are made of a number of pieces that require assembly before use. The present invention also utilizes a simple spring drive system, similar to lower capacity magazines, where other prior art high capacity magazines tend to utilize more complicated systems

SUMMARY OF THE INVENTION

In view of the foregoing disadvantages inherent in the known types of firearm magazines, this invention provides a four round stack ammunition magazine that is compatible with current firearm platforms. As such, the present invention's general purpose is to provide a new and improved magazine that utilizes a single unified follower to move four staggered stacks of ammunition from a storage area, through a transition area and into the weapon as needed.

To accomplish these objectives, the high capacity magazine comprises a broad general storage area capable of holding four staggered stacks of ammunition, a unified follower on a spring system biasing the follower and associated ammunition, a dividing wall to provide a barrier separating two dual staggered round stacks, and a transition area between the feed end of the magazine and the storage area.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 3:
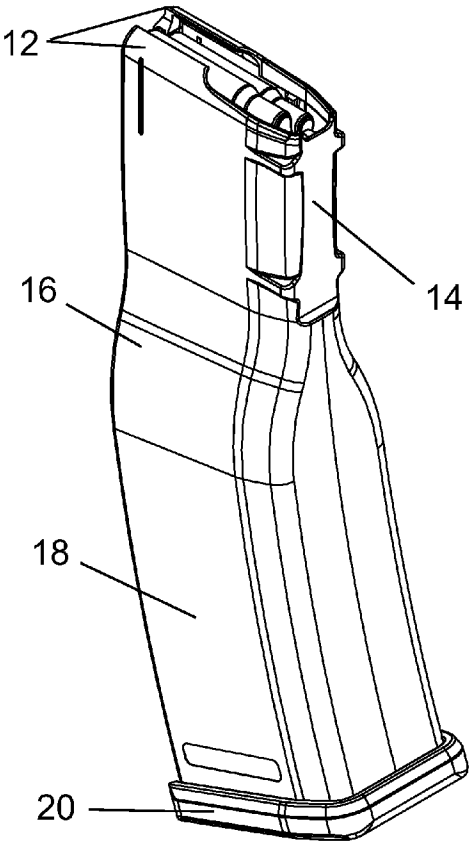
FIG. 3 is a top front perspective view of the magazine of FIG. 1.
Figure 2:
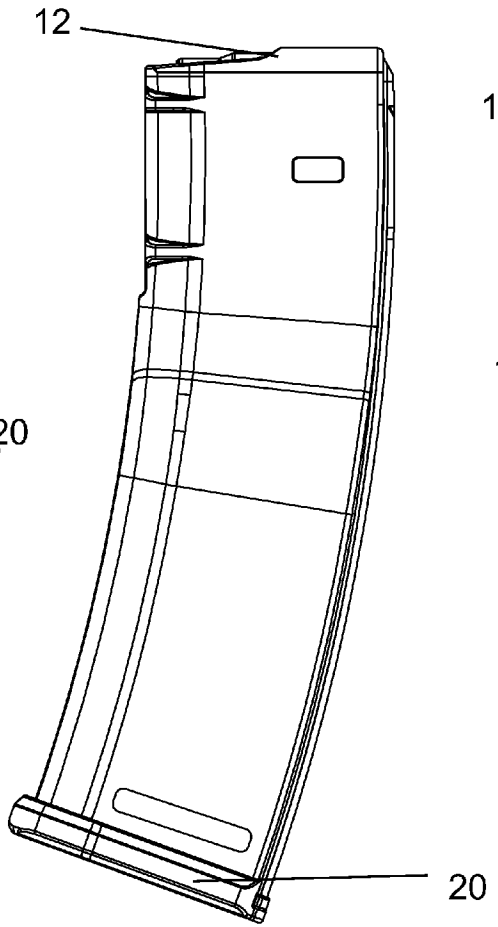
FIG. 2 is a left plan view of the magazine of FIG. 1.
Figure 1:
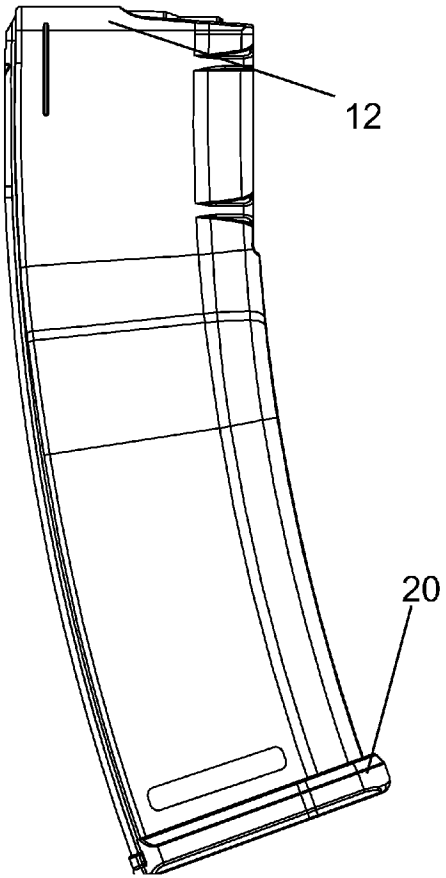
FIG. 1 is a right plan view of an ammunition magazine according to the present invention.
Figure 6:
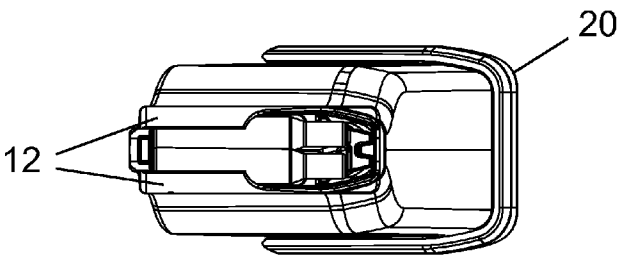
FIG. 6 is a top plan view of the magazine of FIG. 1.

With reference now to the drawings, the preferred embodiment of the . . . is herein described. It should be noted that the articles "a", "an", and "the", as used in this specification, include plural referents unless the content clearly dictates otherwise.

With reference to FIGS. 1-9, the magazine comprises three regions, the feed region 14, the flared transition region 16, and the wider storage region 18. The feed region 14 is designed to interface with a desired weapon platform, such as the AR15/M16, and ejects rounds of ammunition into the weapon system as needed to reload the weapon. Feed lips 12 are present at the opening of the magazine feed region 14 so as to control feeding of the ammunition. The storage region comprises the "floor end" of the magazine and presents a ridge 22 upon which floor plate 20 slides to seal the components of the magazine inside and to provide a force platform for the follower spring system. Floor plate 20 interfaces with tab 34 of the lock plate to stay in position.

One of the important features of the magazine body itself is that it is in one piece, rather than a number of pieces as is found with the prior art, and presents a constant internal curve to lessen disadvantageous follower tilt. It also provides guides for the use of "stripper clips" in order to reload the magazine. The transition region 16 is also asymmetrical, accounting for variations in the round stacks as they travel through the transition region 16. The transition region 16 is also lower on the magazine (relative the feed lips 12) than other high capacity magazines, which allows the magazine to be backwards compatible with common weapon systems currently in use, which includes the ability to drop the magazine out of the weapon without manipulation.

Figure 7:
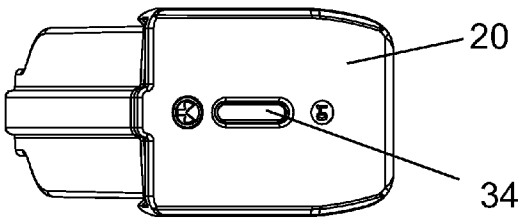
FIG. 7 is a bottom plan view of the magazine of FIG. 1.
Figure 5:
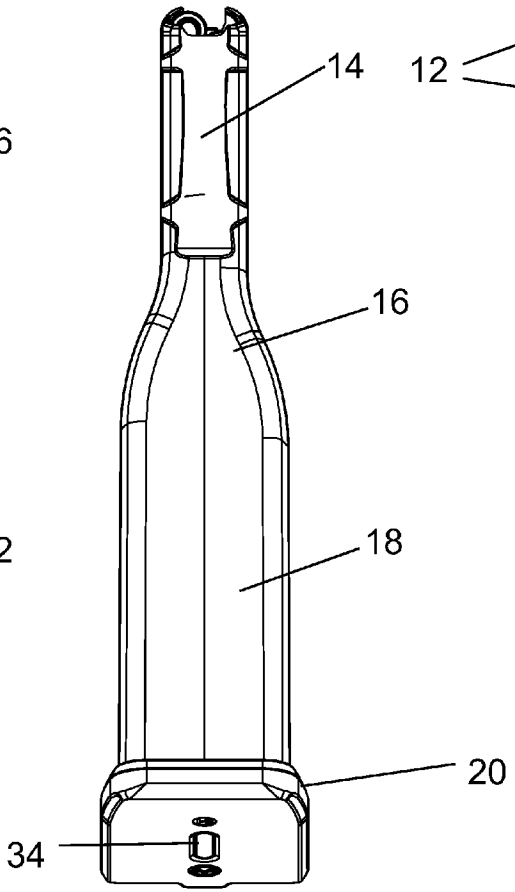
FIG. 5 is a front plan view of the magazine of FIG. 1
Figure 4:
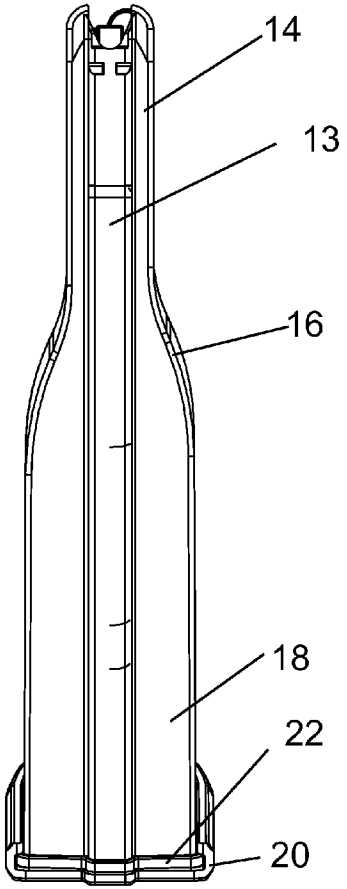
FIG. 4 is a rear plan view of the magazine of FIG. 1
Figure 9:
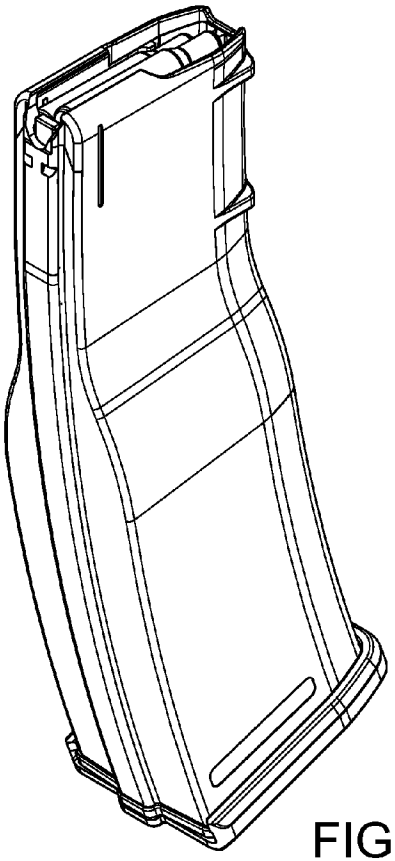
FIG. 9 is a top rear perspective view of the magazine of FIG. 1.
Figure 8:
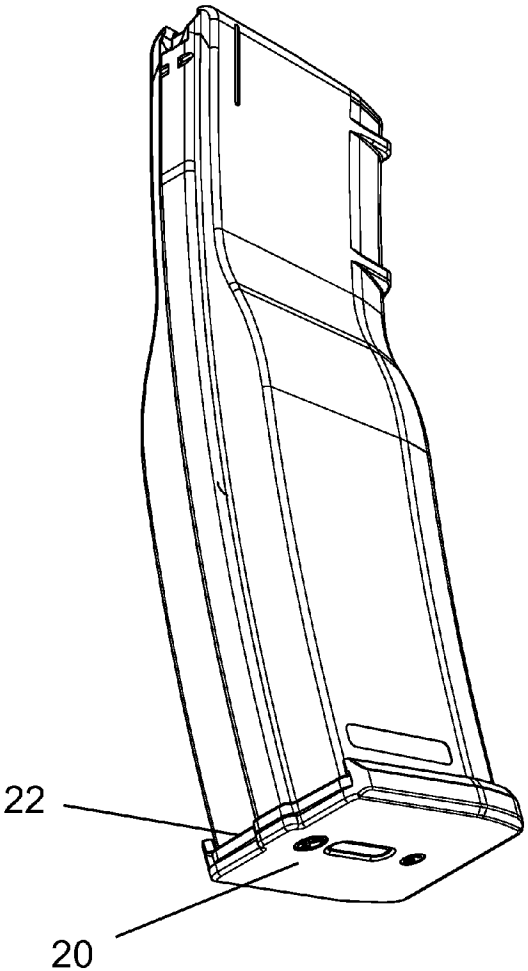
FIG. 8 is a bottom perspective view of the magazine of FIG. 1.
Figure 11:
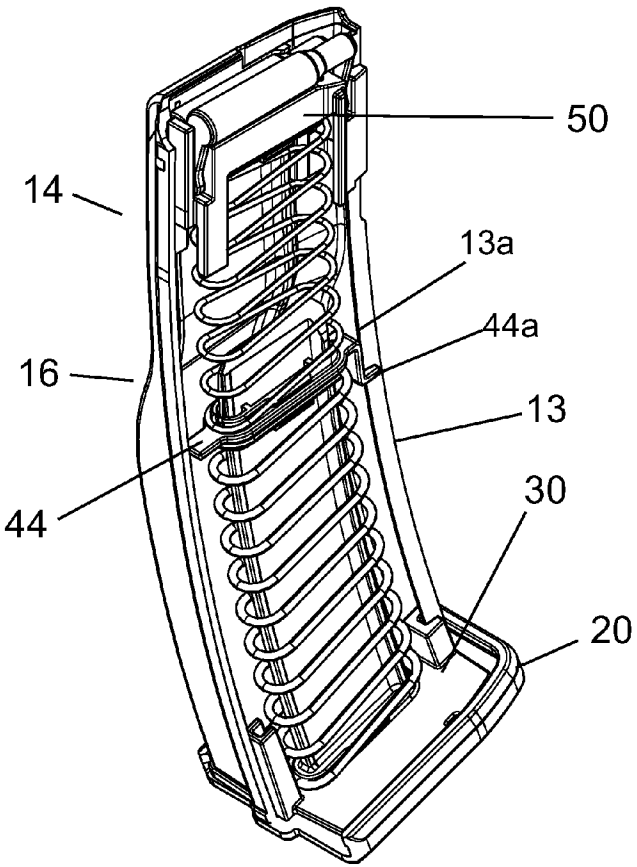
FIG. 11 is a partial cut-away view of the magazine in the same orientation of FIG. 9.
Figure 10:
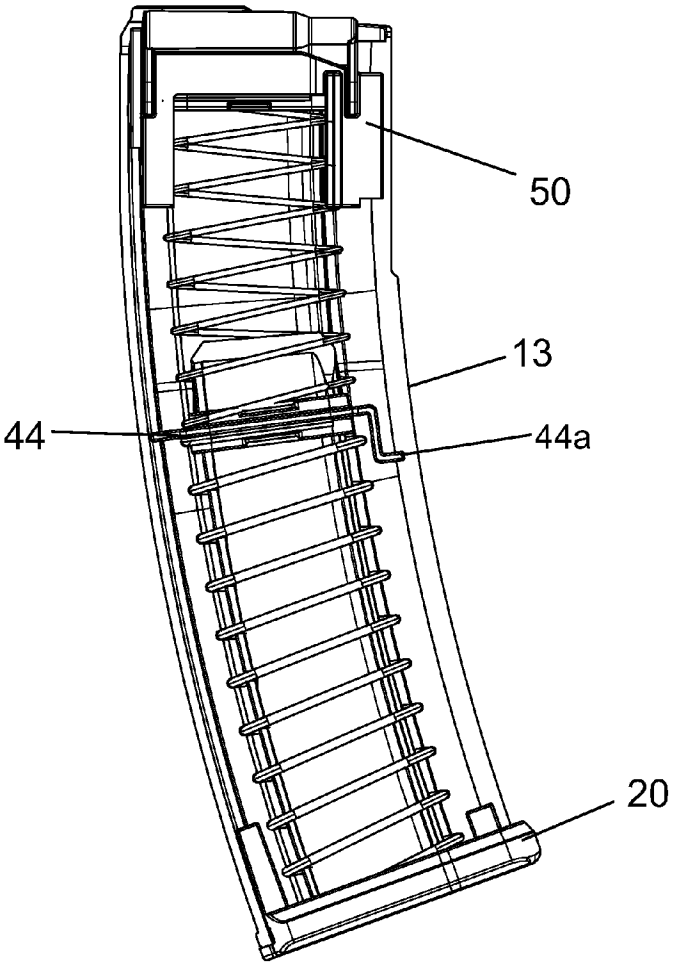
FIG. 10 is a partial cut-away view of the magazine in the same orientation of FIG. 1.
Figure 14:
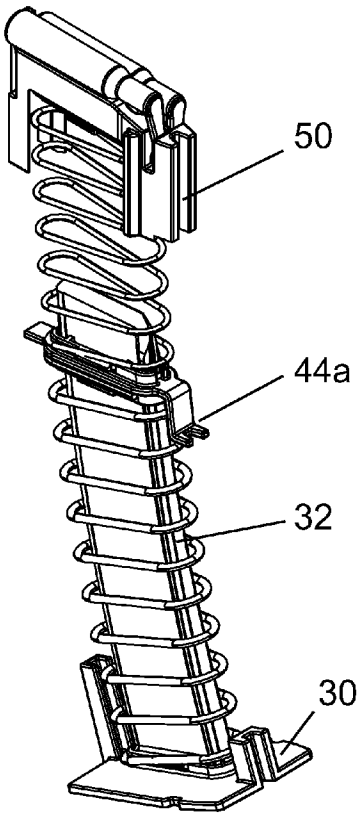
FIG. 14 is a perspective view of the internal assembly of FIG. 12.
Figure 13:
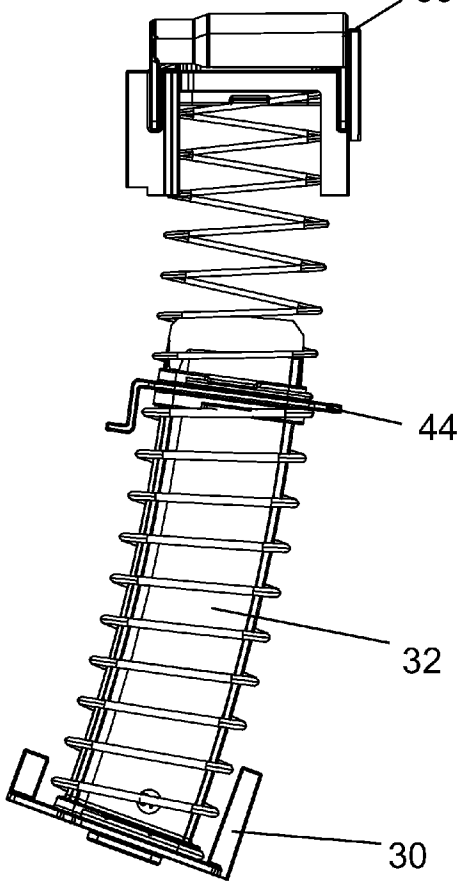
FIG. 13 is a left plan view of the internal assembly of FIG. 12.
Figure 12:
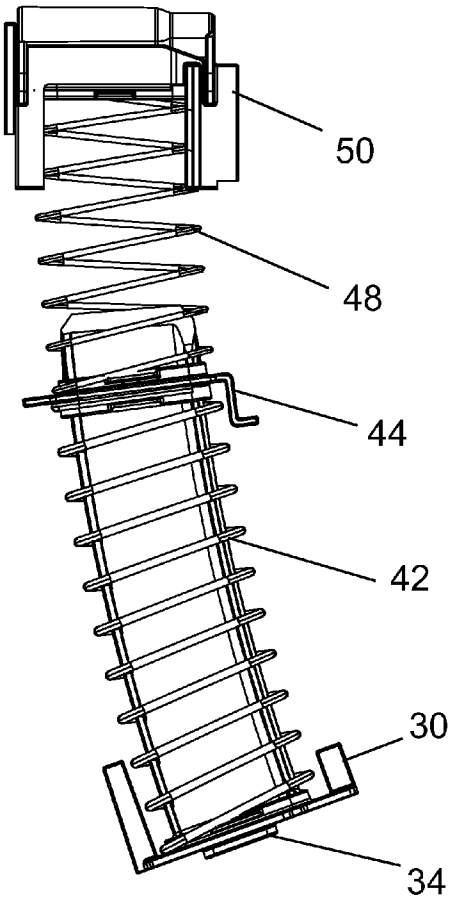
FIG. 12 is right plan view of the internal assembly of the magazine of FIG. 1.

The internal structure of the magazine is simple. As with most magazines and as shown in FIGS. 10 and 11, the present invention utilizes a follower 50 and spring system to incrementally move stacks of ammunition through the transition region 16 and into the feed region 14. The preferred embodiment utilizes a lock plate 30 residing within the magazine to provide a base for the spring system and to project a tab 34 through the floor plate 20 and so lock it in place as the lock plate is continually biased outward from the spring and into the floor plate 20 (FIG. 7). This biasing prevents the tab 34 from being removed from the floor plate 20 and arrests lateral motion of the floor plate, thereby keeping it in position. The internal pieces are more clearly depicted in FIGS. 12-14. The preferred spring system is a dual series spring system. Base spring 42 is heavier than top spring 48 and has a larger spring constant. Top spring 48 interfaces with follower 50 while base spring 42 interfaces with lock plate 30. They are joined at spring splicer 44. Spring splicer 44 has a travel guide 44*a* that follows the inside 13*a* of the spine of the magazine 13 (FIG. 11) when inserted into the magazine. The structure of the spring system provides maximum power to move ammunition through the magazine at the lower regions and through the transition, where it is most needed. It also provides a less powerful spring in the feed region 14, where a more powerful spring could disrupt the feeding cycle. Alternatively, a parallel spring system may be utilized, or a combination of parallel and serial springs, or a single, variable constant spring could be utilized.

Figure 17:
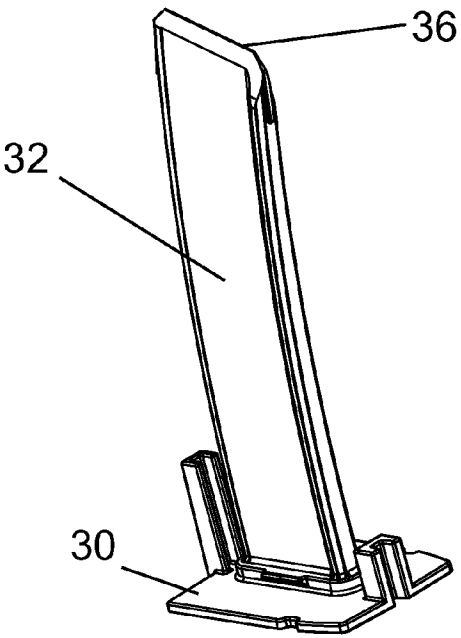
FIG. 17 is a perspective view of the lock plate of FIG. 15.
Figure 16:
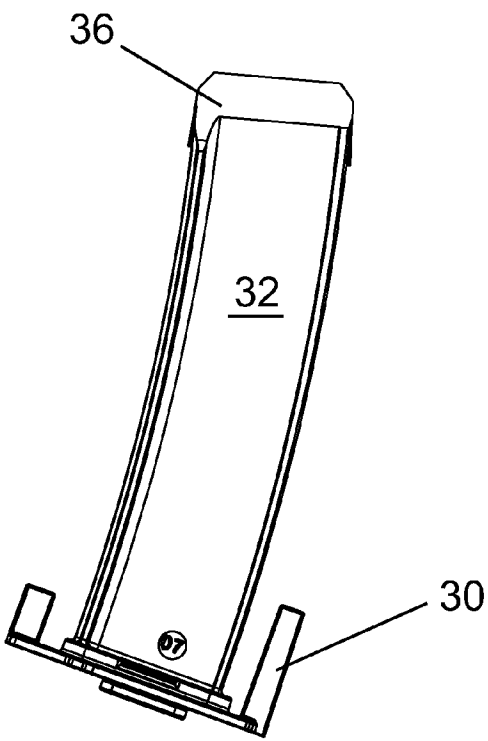
FIG. 16 is a left plan view of the lock plate of FIG. 15.
Figure 15:
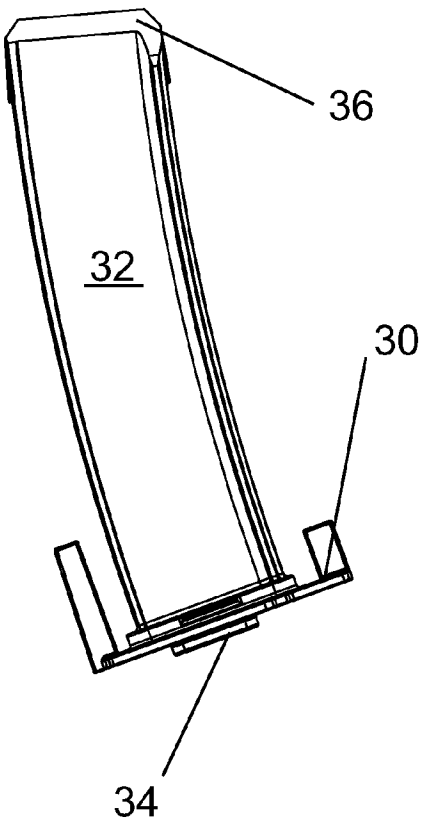
FIG. 15 is a right plan view of a lock plate according to the present invention.
Figure 20:
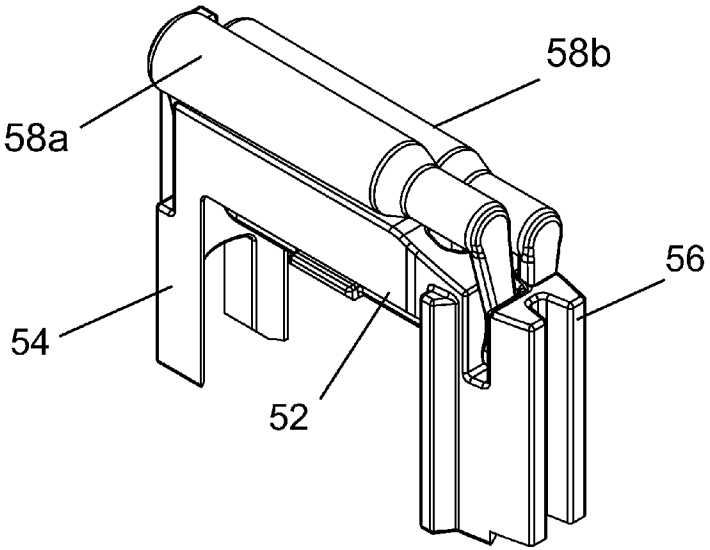
FIG. 20 is a perspective view of the follower of FIG. 18.
Figure 19:
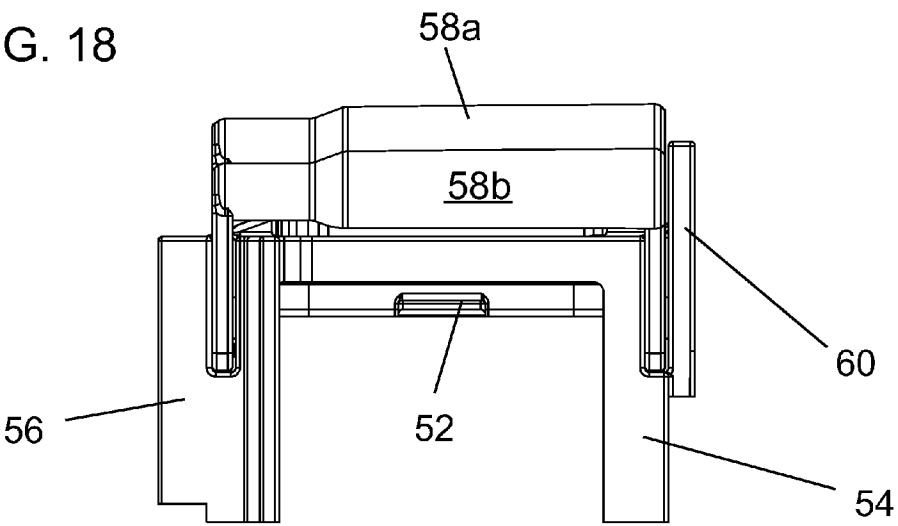
FIG. 19 is a left plan view of the follower of FIG. 18
Figure 18:
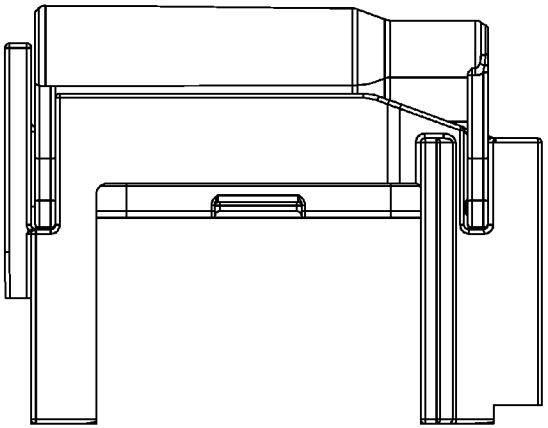
FIG. 18 is a right plan view of a magazine follower according to the present invention.
Figure 21:
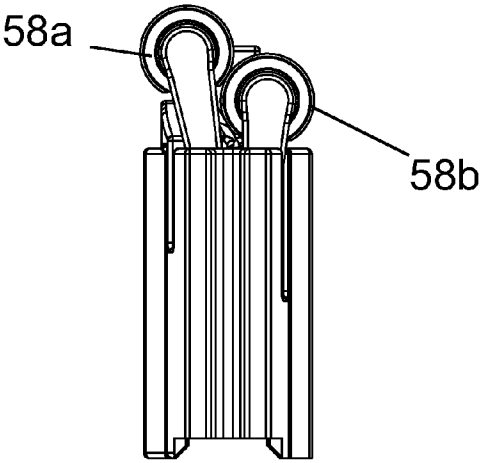
FIG. 21 is a rear plan view of the follower of FIG. 18.
Figure 22:
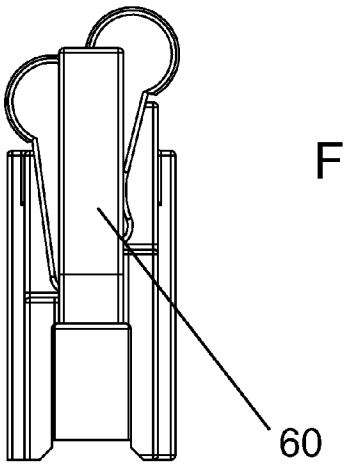
FIG. 22 is a front plan view of the follower of FIG. 18.
Figure 23:
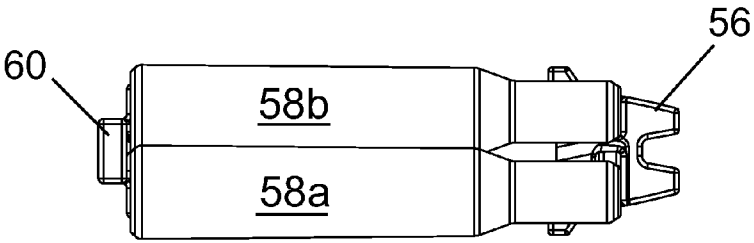
FIG. 23 is a top plan view of the follower of FIG. 18.
Figure 24:
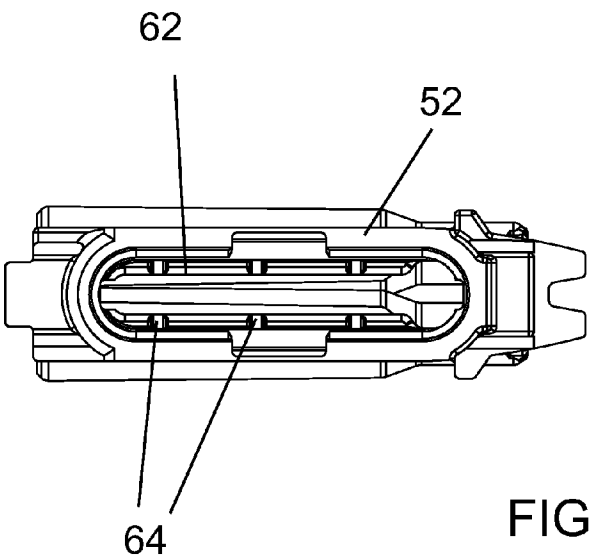
FIG. 24 is a bottom plan view of the follower of FIG. 18.

The lock plate, shown in FIGS. 15-17, provides a base for the spring system. A long dividing partition 32 extends upwards and centrally from the lock plate 30. The partition 32 provides support in the storage region for the ammunition by dividing the storage region into two sections and provides a wall upon which two sets of ammunition stacks may rest. At the top of the partition is a blade 36 that parts the round stacks into two sets of two stacks as the magazine is loaded and also provides a slope for travel of the stacks during deployment. The spring system also encompasses the partition 32 as it uncoils, so the partition also supports the springs, particularly the upper spring 48 when the spring system is compressed into the storage region 18.

The follower 50 (FIGS. 18-24) is unitary and specially constructed with a platform 52 having two leg extensions 54, 56 depending there from. Two pivoting bails 58*a*, 58*b* provide support for the ammunition stacks. The bails 58*a*, 58*b* pivot at the follower 50 travels up and down along the interior of the magazine and part when the follower contacts blade 36 of the lock plate 30. Normally, bails 58*a*, 58*b* are spring biased together to better enable supporting ammunition stacks. Platform 52 has an orifice 62 through which the partition 32 may pass and a rim 64 whereby it may rest on the top spring 48. Rear leg 54 also presents a bolt block 60 so that the bolt of the firearm will not interact with the bails 58*a*, 58*b* when the magazine is empty. Bolt block 60 also interfaces with the spine of the magazine 13 as the follower 50 travels through the magazine. Both legs 54, 56 are configured to maximize interface with the interior of the magazine.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. An ammunition magazine comprising:

a. A magazine casing, further comprised of:

i. a lower storage section with a rectangular cross-sectional area, having two longer sides and two shorter sides;

ii. an upper feed section with a rectangular cross-sectional area, likewise having two longer sides and two shorter sides corresponding to the longer and shorter sides of the lower storage section and the cross-sectional area of the upper feed section being smaller than that of the lower storage section; and iii. a medial transitional area with a variable and asymmetrical cross-sectional area gradually decreasing from the cross-sectional area of the storage section to the cross-sectional area of the feed section, the shorter sides of the lower storage section and the upper feed sections defining shorter sides of the magazine casing and one of the shorter sides of the casing being defined as a spine;

b. a floor plate, capable of interface about an orifice of the storage section;

c. a locking plate, residing internal of the orifice of the storage section further comprising an interface tab, projecting from an obverse side in a manner to interface with the floor plate and a partition extending from a reverse side of the lock plate into an interior of the storage section of the casing;

d. a follower spring;

e. a spring guide positioned on the spring in a manner to interface with the spine of the magazine and assist progression of the spring through the magazine; and f. a follower having a slit such that it is capable of straddling the partition.

2. The magazine of claim 1, the follower having at least one pivotable bail.

3. The magazine of claim 1, the follower spring being a composite spring comprising a plurality of springs, representing at least two different spring constants, connected in series to each other.

4. The magazine of claim 3, the follower having at least one pivotable bail.

5. The magazine of claim 3, the plurality of springs being joined by a spring splicing apparatus comprising the spring guide projecting from a side of the splicing apparatus in a manner to interface with the spine of the casing.

6. The magazine of claim 5, the follower having at least one pivotable bail.

7. The magazine of claim 1, the casing being of one piece, having no separable parts.

8. The magazine of claim 7, the follower having at least one pivotable bail.

9. The magazine of claim 7, the follower spring being a composite spring comprising a plurality of springs, representing at least two different spring constants, connected in series to each other.

10. The magazine of claim 9, the follower having at least one pivotable bail.

11. The magazine of claim 9, the plurality of springs being joined by a spring splicing apparatus, said apparatus comprising the spring guide.

12. The magazine of claim 11, the follower having at least one pivotable bail.

13. The magazine of claim 7, the casing having a constant internal curve.

* * * * *